US007331465B2

(12) United States Patent
Parrington

(10) Patent No.: US 7,331,465 B2
(45) Date of Patent: Feb. 19, 2008

(54) DEVICE WITH A HOLLOW LID SUPPORTING CONTENTS

(75) Inventor: Nicolas Parrington, Brussels (BE)

(73) Assignee: COSFIBEL, Brussels (BE)

( * ) Notice: Subject to any disclaimer, the term of this patent is extended or adjusted under 35 U.S.C. 154(b) by 148 days.

(21) Appl. No.: 11/023,377

(22) Filed: Dec. 29, 2004

(65) Prior Publication Data

US 2006/0096888 A1 May 11, 2006

(30) Foreign Application Priority Data

Nov. 10, 2004 (FR) ..... 04 11971

(51) Int. Cl.
*B65D 81/02* (2006.01)

(52) U.S. Cl. ..... 206/583; 206/589

(58) Field of Classification Search ..... 206/521, 206/523, 587–590, 592, 485–486, 562–563; 229/406; 220/4.21–4.24
See application file for complete search history.

(56) References Cited

U.S. PATENT DOCUMENTS 2,778,487 A 1/1957 Raeburn
3,146,929 A * 9/1964 Keim ..... 229/406
3,167,235 A * 1/1965 Hailey et al. ..... 206/589
3,254,758 A * 6/1966 Reynolds ..... 229/203
3,497,057 A 2/1970 Traner et al.
4,173,286 A * 11/1979 Stanko ..... 206/589
5,127,526 A * 7/1992 Vigue ..... 206/587
6,109,444 A * 8/2000 Bagwell et al. ..... 206/589
6,398,026 B1 * 6/2002 Parsons ..... 206/521
6,474,473 B2 * 11/2002 Wong ..... 206/590

FOREIGN PATENT DOCUMENTS

DE 8006903 6/1980
FR 2216813 8/1974

* cited by examiner

*Primary Examiner*—Bryon P. Gehman
(74) *Attorney, Agent, or Firm*—Clark & Brody

(57) ABSTRACT

A package-forming device comprising a box-forming element and a lid-forming element, wherein the lid-forming element includes a blister-type portion forming a packaging element provided with one or more recesses for receiving one or more articles to be packaged.

9 Claims, 3 Drawing Sheets

INVENTION

DEVICE WITH A HOLLOW LID SUPPORTING CONTENTS

The present invention relates to a device forming a package having an element forming a hollow lid, with a surface forming a packaging element.

STATE OF THE ART

In the state of the prior art, numerous package-forming devices are known. Such devices generally comprise a box-forming element having a top opening through which articles for packaging are inserted, and a lid-forming element having a side skirt that is positioned on the outside of the box-forming element in the closed position.

In order to house articles for packaging, a packaging element is also provided having housings that correspond to the dimensions of said articles to be packaged.

Thus, prior art devices comprise at least three distinct elements, namely a box-forming element, a lid-forming element, and a packaging element for housing the articles.

The box-forming element is also generally formed by being cut out from a generally plane sheet so as to define respectively a bottom surface, and side surfaces for the box-forming element, which side surfaces need to be folded up and joined together. In order to save space, it is possible to form the box-forming element at the time of packaging by folding up said side surfaces substantially vertically and by joining them together, e.g. by adhesive. It is therefore necessary either to have adhesive means available when forming the box-forming element, or else to preposition corresponding adhesive surfaces on said side surfaces, which adhesive surfaces are temporarily protected by protective sheets that need to be removed when the box is formed.

It can thus be understood that these manufacturing operations require at least three distinct parts to be made, and adhesive operations to be performed, and that is relatively expensive and inconvenient for a user seeking to make such a package.

OBJECTS OF THE INVENTION

A main object of the invention is to solve the novel technical problem consisting in providing a solution that enables packages to be made with a smaller number of distinct parts, and preferably with only two elements.

Another main object of the invention is to solve the novel technical problem consisting in providing a solution that enables packages to be made without it being necessary to perform operations of joining together the side surfaces of the box-forming element, and in particular to avoid doing so by means of adhesive or heat-sealing.

Another main object of the invention is to solve the novel technical problem using a solution that is particularly simple, inexpensive, safe, and reliable, and suitable for use on an industrial and commercial scale.

DETAILED DESCRIPTION OF THE INVENTION

The invention solves the novel technical problems specified above for the first time by means of a solution that is particularly simple, inexpensive, safe and reliable, and suitable for use on an industrial and commercial scale.

Thus, the invention provides a package-forming device comprising a box-forming element having a top opening for insertion of one or more articles to be packaged, and a lid-forming element having longitudinal and transverse side portions, a peripheral rib, and a side skirt that is positioned outside the box-forming element in the closed position, wherein the lid-forming element is hollow and includes a portion forming a packaging element provided with one or more housings into which said articles for packaging are inserted.

In an advantageous embodiment of the invention, said peripheral rib is continued with the longitudinal and transverse side portions of dimensions sufficient to enable the portion forming a packaging element to be disposed at a level lower than that of the plane P defined by the top opening of the box-forming element, so as to enable at least one article to be housed inside the box-forming element, the article(s) being of a volume greater than that of the housing provided therefor.

In another advantageous embodiment of the invention, the box-forming element is formed by being cut out from a substantially plane sheet so as to define respectively a bottom surface, and side surfaces for the box-forming element, the lid-forming element making it possible by means of its peripheral rib and its side skirt to hold the side surfaces of the box-forming element in the assembled position.

In yet another advantageous embodiment of the invention, the lid-forming element including the portion forming a packaging element is formed from a semirigid sheet made of a hot deformable material, e.g. a thermoplastic material, to enable said peripheral rib to be formed easily by hot deformation, e.g. by stamping.

In yet another advantageous embodiment of the invention, the lid-forming element including the portion forming a packaging element is made of a hot deformable material such as polyethylene, polypropylene, or a corresponding copolymer.

In another advantageous embodiment of the invention, the material of the box-forming element is made of a packaging material such as card.

In yet another advantageous embodiment of the invention, the device includes a protective sheet or sheath for protecting the package-forming device, which sheet or sheath is preferably transparent and has a surface area that is sufficient to completely surround the box-forming element and the lid-forming element.

It can thus be understood that the invention does indeed solve the above-specified novel technical problem of limiting the number of elements needed for making package-forming devices, in particular by limiting this number to two distinct parts, i.e. a box-forming element and a lid-forming element, and does so without making it necessary to use fastener means, and in particular without needing to use adhesive or heat-sealing of any kind, and does so in a manner that is simple, inexpensive, safe and reliable, and suitable for use on an industrial and commercial scale.

Other objects, characteristics, and advantages of the invention appear clearly in the light of the following explanatory description made with reference to a particularly advantageous embodiment of a package-forming device of the invention that is given purely by way of illustration and that therefore is not limiting in any way on the scope of the invention.

It should be observed that the embodiment shown in FIGS. 1 to 6 forms an integral part of the invention and that any characteristic which appears to be novel compared with any state of the art on the basis of the description taken as a whole and thus including FIGS. 1 to 6 is claimed as such in its generality, and thus in its function.

DESCRIPTION OF THE FIGURES

In the drawings:

With reference to FIG. 1, there is shown a box-forming element given overall reference number 10, forming part of a prior art packaging device. This box-forming element 10 is formed by being cut out from a substantially plane sheet 12, e.g. made of card, so as to define respectively a bottom surface 13, and side surfaces referred to respectively as longitudinal side surfaces 14, 16 and transverse side surfaces 18, 20. As shown in FIG. 1, the transverse side surfaces 18, 20 are designed to include on either side a pair of foldable flaps given respective references 18*a* & 18*b* and 18*c* & 18*d* for the side surface 18; and 20*a* & 20*b* and 20*c* & 20*d* for the side surface 20.

Figure 1:
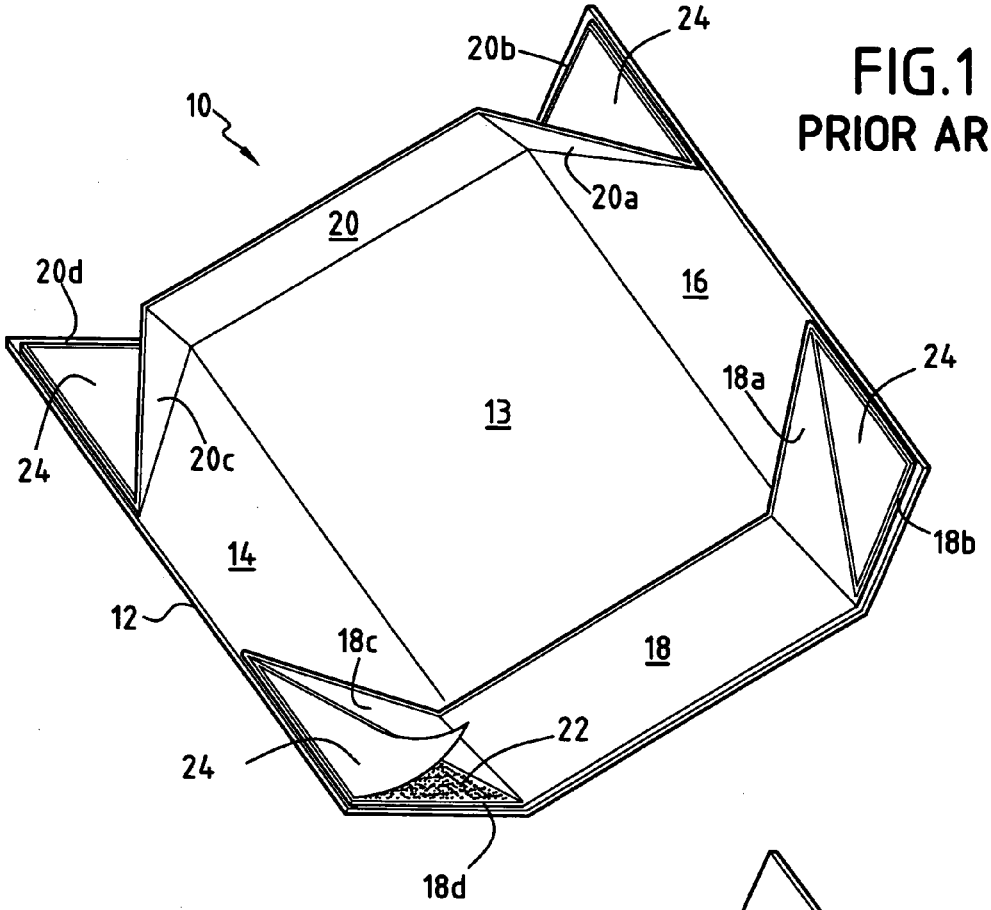
FIG.1 PRIOR ART
FIG. 1 is a view from above of a prior art embodiment of the box-forming element of a packaging device in which two opposite side faces have respective double folds, one of which is shown as already being fastened on either side with another side face, and showing the double-sided adhesive elements.

In this prior art embodiment, it is necessary to fasten at least one foldable flap such as 18*b*, 18*d*, 20*b*, and 20*d* in permanent manner to a longitudinal side surface 16 or 14, e.g. by adhesive.

Provision is generally also made to provide the surface facing the flaps such as 18*a*, 18*b*; 18*c*, 18*d*; 20*b*, 20*a*; 20*d*, and 20*c* with double-sided adhesive elements 22 whose visible faces are protected by protective sheets until the time of use.

The box-forming element 10 can therefore be stored while in a substantially flat state until the time the package is to be formed.

When the package is formed, it suffices to remove the protective sheets 24 from the various flaps so as to enable the flaps to be assembled together in pairs, in a manner that is easily understood by the person skilled in the art.

It will be understood that making the box-forming element 10 is complex insofar as it requires fastener means of significant size, with these fastener means being protected until the time the package is formed.

With reference to FIGS. 2 to 6, the invention provides a solution to the novel technical problems set forth by the invention, firstly concerning reducing the number of distinct parts that are needed for making a package-forming device, and second relating to the absence of fastener means for fastening the side faces of the box-forming element.

In the presently-preferred embodiment that is shown, the invention provides a package-forming device given overall reference numeral 100.

Figure 2:
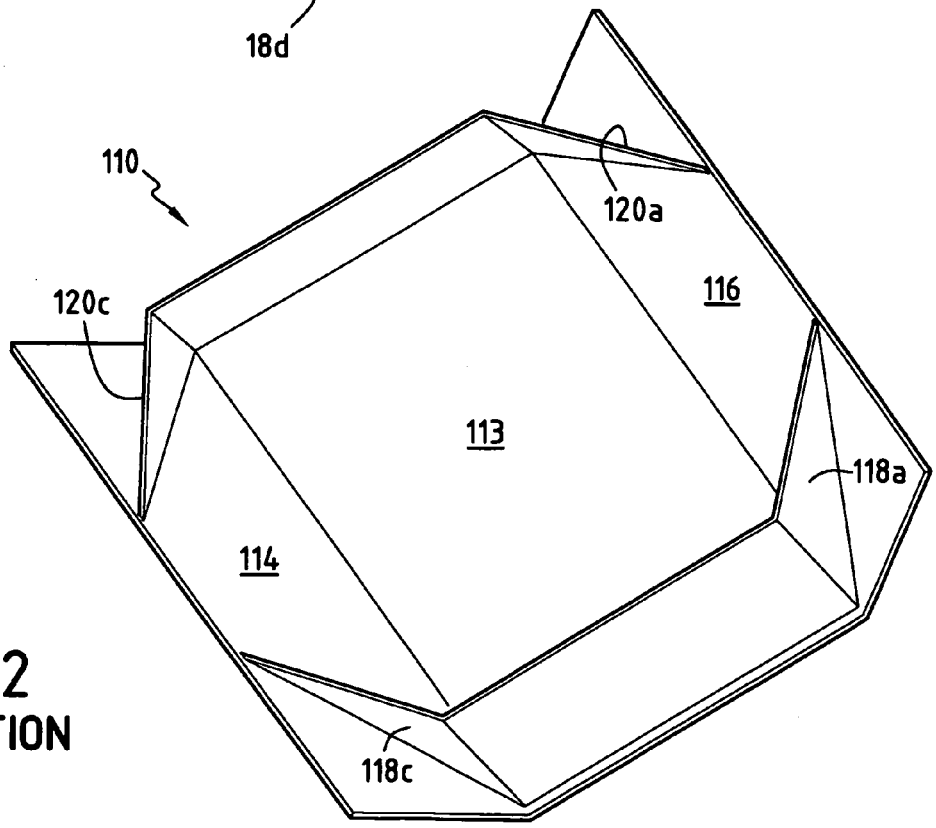
FIG. 2 shows a first embodiment of a box-forming element of a packaging device of the present invention which does not require fastener means, in particular means using adhesive or heat-sealing for fastening together at least one fold of a side face to the inside of another side face.

In the invention, the box-forming element 110 can likewise be made from a single sheet such as a sheet of card, and it likewise comprises a bottom-forming surface 113, and longitudinal side surfaces 114, 116 and transverse side surfaces 118, 120, together with side flaps, e.g. on the transverse side surfaces, where said flaps can be simplified and restricted to one flap per side, e.g. 118*a*, 118*c*, 120*a*, and 120*c*, as can be seen clearly in FIG. 2.

Figure 5:
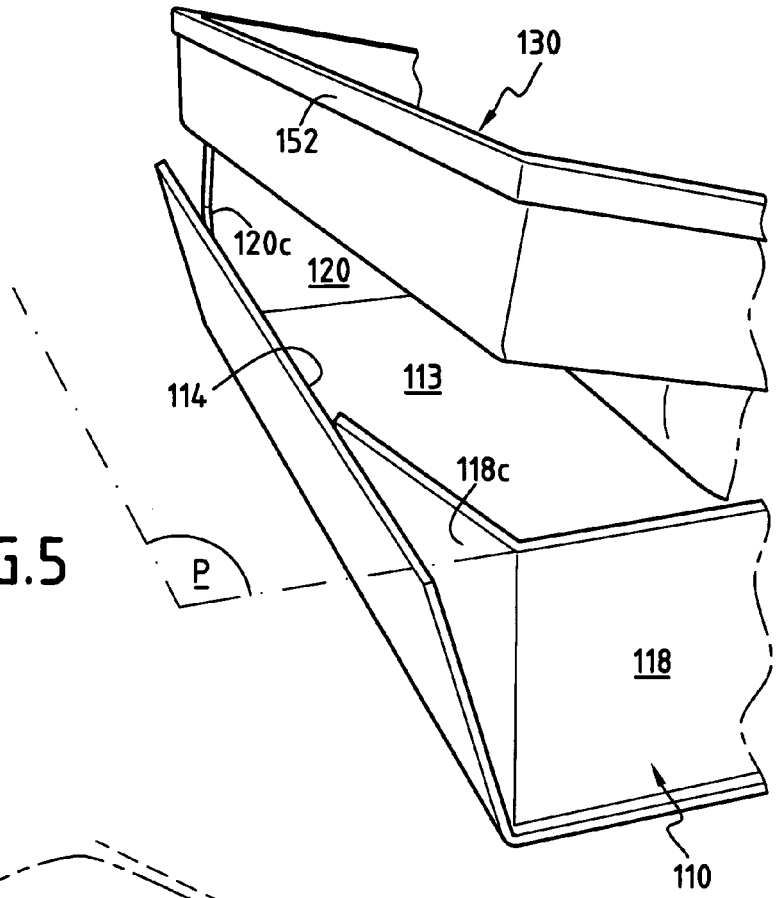
FIG. 5 is a fragmentary view showing the step of mounting the lid-forming element on the box-forming element whose side walls have not been fastened together, in a manner that is easily understood by the person skilled in the art.
Figure 6:
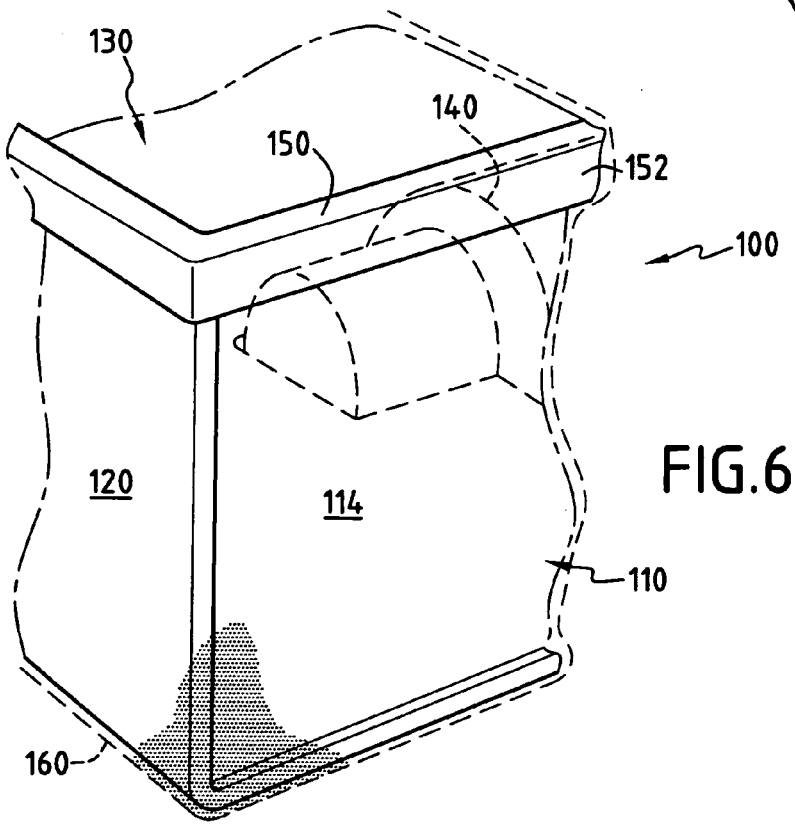
FIG. 6 shows the packaging-forming device of the invention in the packaged state.

In the context of the invention, there is no need to fasten the side flaps to the longitudinal surfaces 114, 116 as will be understood on considering the description of FIGS. 5 and 6.

Figure 3:
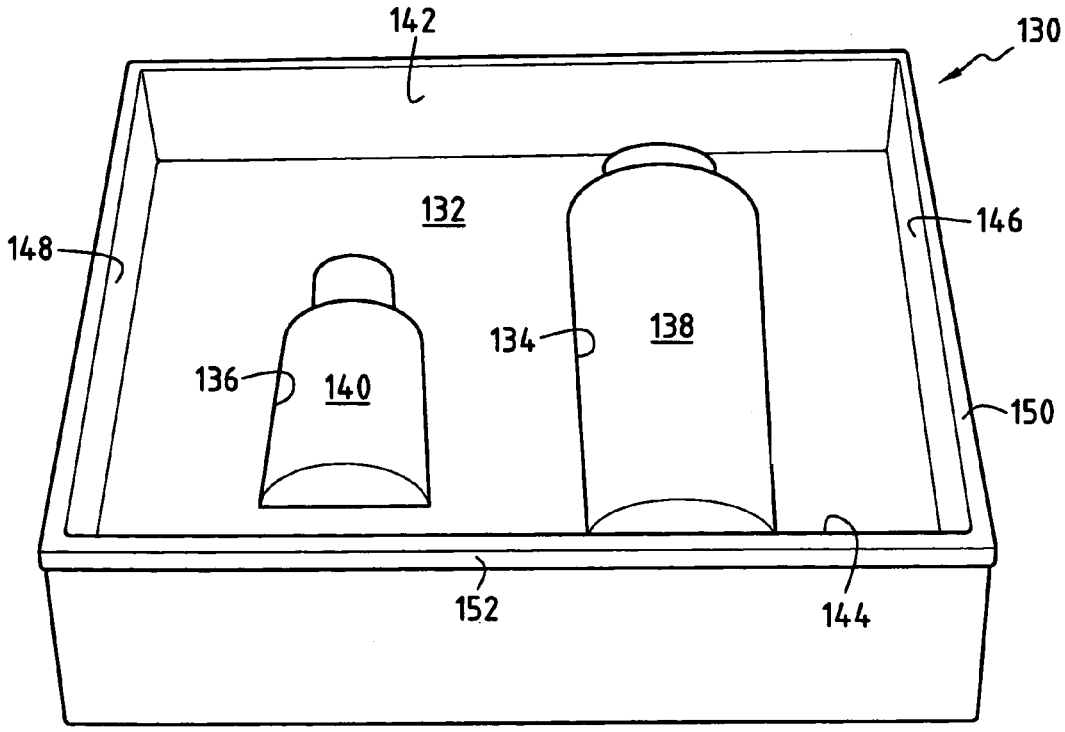
FIG. 3 is a view from above of a first embodiment of a hollow lid-forming element of the invention having a portion forming a packaging element provided with one or more housings for receiving one or more articles for packaging, and including a peripheral rib defining the side skirt of the lid-forming element.
Figure 4:
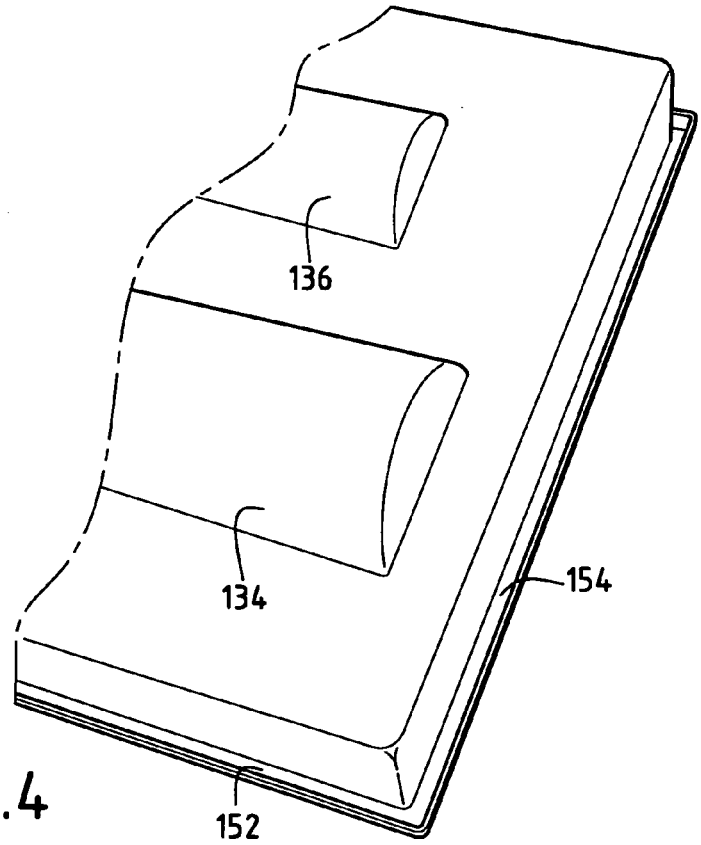
FIG. 4 is a view from beneath showing a fragment of the lid-forming element of the invention as shown in FIG. 3.

With reference to FIGS. 3 and 4, there is shown the presently-preferred embodiment of the invention relating to the design of a novel lid-forming element given overall reference numeral 130. The lid-forming element 130 is hollow and comprises a portion 132 forming a packaging element provided with one or more housings 134, 136 into which one or more articles for packaging such as bottles or flasks 138, 140 are inserted, said bottles or flasks containing various consumables, cosmetics, or foods. This portion 132 forming a packaging element co-operates with or forms an integral portion of the lid-forming element 130 which has longitudinal side walls 142, 144 and transverse side walls 146, 148 and a peripheral rib 150, preferably of substantially U-shaped section and defining a peripheral side skirt 152 for fitting over the edges of the side faces 114, 116, 118, 120 of the box-forming element 100, as explained in greater detail below with reference to FIGS. 5 and 6.

In a particular advantageous embodiment of the invention, said peripheral rib 152 is continued with the longitudinal side portions 142, 144 and transverse portions 140, 148 of a dimension that is sufficient to enable the portion 132 forming a packaging element to be disposed at a level that is lower than that of the plane P defined by the top opening 124 of the box-forming element 110, so as to enable at least one article such as 138, 140 to be housed inside the box-forming element 110, the article being of a volume that is greater than the volume of the housing 134, 136 that is provided to receive it.

In yet another advantageous embodiment of the invention, the lid-forming element 130 including the portion 132 forming a packaging element is made from a single semi-rigid sheet made of a hot deformable material, e.g. a thermoplastic material, so as to make it easy to form said peripheral rib by hot deformation, e.g. by stamping.

In yet another advantageous embodiment of the invention, the lid-forming element 130 including the portion 132 forming a packaging element is made of a hot deformable material such as polyethylene, polypropylene, or a corresponding copolymer.

In another advantageous embodiment of the invention, the material of the box-forming element 110 is made of a packaging material such as card.

In yet another advantageous embodiment of the invention, the device includes a protective sheet or sheath 160 for protecting the package-forming device, e.g. a sheet or sheath made of a transparent material and having a surface area that is large enough to surround the box-forming element and the lid-forming element completely.

With reference to FIGS. 5 and 6, it will be understood that the box-forming element 110 is assembled with the lid-forming element 130 in a manner that is particularly simple. It suffices to raise the side surfaces 114, 116, 118, and 120 without there being any need to fasten them together, as shown in FIG. 5, and to insert the lid-forming element 130 with the side skirt 152 passing over the edges of the side faces such as 118, 114 of the box-forming element 110, in order to fasten said side faces in the groove 154 defined by the rib 150 and become locked therein by the peripheral side skirt 152.

The peripheral side skirt 152 is thus large enough to cover the side surfaces 114, 116, 118, and 120 sufficiently to avoid untimely disassembly. The size of the groove 154 is thus advantageously designed to be slightly narrower than the thickness of the edges of the side faces 114, 116, 118, and 120 of the box-forming element 110.

In the context of the invention, the package can advantageously be finished off by using a protective sheet or sheath for protecting the package-forming device, such as the preferably transparent sheet or sheath referenced 160 in FIG. 6, which sheet or sheath is generally decorative and has a surface area that is sufficient to surround completely the box-forming element and the hollow lid-forming element, thereby providing an additional function of holding the lid-forming element 130 on the box-forming element 110.

As stated above, the invention does indeed solve the above-specified novel technical problems, namely limiting the number of distinct parts for use in making a package-forming device, and avoiding the use of fastener means, and in particular any kind of adhesive or heat-sealing between the side walls of the box-forming element 110, and does so in a manner that is simple, inexpensive, safe, and reliable, and suitable for use on an industrial and commercial scale. The invention covers all means constituting technical equivalents of the means described and shown in accompanying FIGS. 2 to 6, which form integrated portions of the invention.

What is claimed is:

1. A package-forming device comprising a box-forming element having a top opening for insertion of one or more articles to be packaged, and a lid having an opening defined at its uppermost plane, a depressed central lid portion with a topside, longitudinal and transverse side portions extending upwardly from the topside, an outwardly extending peripheral rib, and a side skirt that extends downwards from the peripheral rib and outside the box-forming element when said lid is in a lid-closed position, and wherein an underside of said depressed central lid portion includes at least one article receiving indent for respectively retaining, when said lid is in said lid-closed position, the one or more articles when inserted in said box-forming element in one or more preselected positions, wherein the upper surface of each indent is located at a predetermined distance below the plane of the lid opening, thereby having the one or more articles to be packaged substantially entirely positioned below the plane of the lid opening.

2. A device according to claim 1, wherein said peripheral rib is positioned above said depressed central lid portion.

3. A device according to claim 1, wherein the lid is formed from a semirigid sheet made of a hot deformable thermoplastic material, to enable said peripheral rib to be formed easily by hot deformation.

4. A device according to claim 1, wherein the box-forming element is formed by being cut out from a substantially plane sheet so as to define respectively a bottom surface, and side surfaces for the box-forming element, the lid element making it possible by means of its peripheral rib And its side skirt to hold the side surfaces of the box-forming element when in said lid-closed position.

5. A device according to claim 1, wherein the lid element is made of a hot deformable polyethylene, polypropylene, or a corresponding copolymer.

6. A device according to claim 1, wherein the material of the box-forming element is card packaging material.

7. A device according to claim 1, including one of a protective sheet or sheath for protecting the device, which sheet or sheath is transparent and has a surface area that is sufficient to completely surround the box-forming element and the lid.

8. A device according to claim 1, wherein the opening of each indent is substantially coplanar with the depressed central lid portion.

9. The device according to claim 1, the depressed central lid portion is located above the bottom surface of the box-forming element.

* * * * *